United States Patent [19]

Kirchmeier

[11] 4,252,181

[45] Feb. 24, 1981

[54] HEAT RECOVERING FAN

[76] Inventor: Johannes Kirchmeier, Bechen-Kleinheide 21, 5067 Kürten, Fed. Rep. of Germany

[21] Appl. No.: 897,633

[22] Filed: Apr. 18, 1978

[30] Foreign Application Priority Data

Apr. 19, 1977 [DE] Fed. Rep. of Germany ..... 2711203

[51] Int. Cl.[3] ..... F28D 19/00

[52] U.S. Cl. ..... 165/7; 165/10; 165/85; 165/125

[58] Field of Search ..... 165/8, 10, 7, 86, 92, 165/125, 85

[56] References Cited

U.S. PATENT DOCUMENTS

| | | | |
|---|---|---|---|
| 1,560,271 | 11/1925 | Lynger | 165/7 X |
| 1,764,535 | 6/1930 | Simmon | 165/92 |
| 1,843,252 | 2/1932 | Toensfeldt | 165/7 |
| 3,009,684 | 11/1961 | Munters | 165/7 X |
| 3,456,718 | 7/1969 | DeFries | 165/10 |
| 3,866,668 | 2/1975 | Doerner | 165/125 X |

FOREIGN PATENT DOCUMENTS

| | | | |
|---|---|---|---|
| 142817 | 9/1935 | Austria | 165/86 |

*Primary Examiner*—Albert W. Davis
*Attorney, Agent, or Firm*—Neil F. Markva

[57] ABSTRACT

The invention relates to a heat-recovering fan comprising a rotating capillary impeller with a separating plate inside to separate the air currents and being in communication with separate supply air and exhaust air outlets. The invention provides a heat recovering fan having a capillary impeller. The optimum heat storage capacity of the capillary impeller is used for effecting a very high degree of heat recovery. The heat recovering fan of this invention has at least one vane wheel used as an air conveyor in combination with the capillary impeller. Consequently, there is a separation between heat exchanger, on the one hand, and air conveyor on the other hand. The capillary impeller may be designed exclusively on the basis of good heat exchanging properties such as type material and dimensions because the air conveyance is effected by at least one vane wheel. The air conveyance is performed by the vane wheel or vane wheels which on their part, are designed in accordance with their sole purposes.

16 Claims, 10 Drawing Figures

FIG. 1
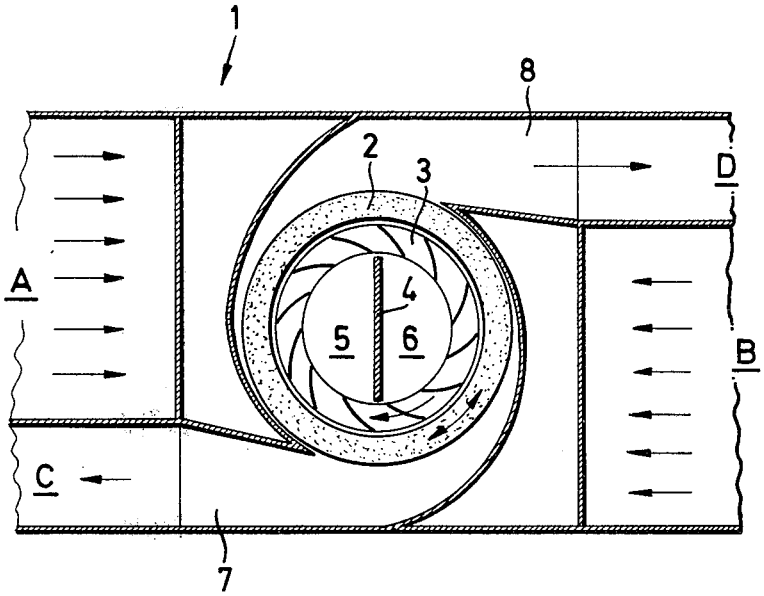
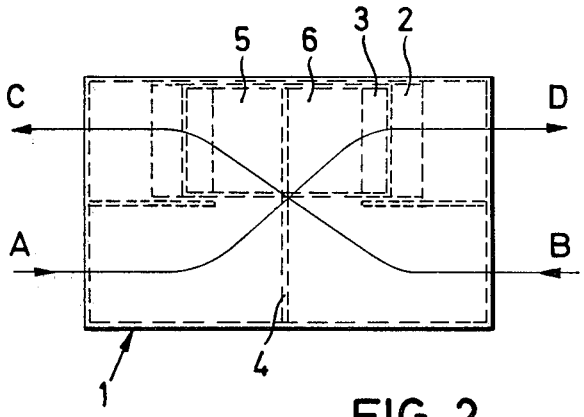
FIG. 2

HEAT RECOVERING FAN

FIELD OF THE INVENTION

The invention relates to a heat-recovering fan comprising a rotating capillary impeller with a separating plate inside to separate the air currents and being in communication with separate supply air and exhaust air outlets.

BACKGROUND OF THE INVENTION

Capillary impellers such as a fiber crown rotor, an annular body composed of foam or other materials are known. From an aerodynamic standpoint, these prior art impellers have a structure suitable to provide a grid effect as developed with the vanes of blower rotors. The air cells of a rotating capillary impeller have a conveying effect. Moreover, the capillary impeller through which air may flow, acts as a storage mass, and accordingly, is suitable for the heat exchange between two air currents of different temperature. The heat exchanging effect of a capillary impeller is used for the heat recovery from exhaust air. To this end, heat is removed from absorbed, spent, warm room air and transferred to the outside air region. The heat removed from the exhaust air is supplied to heat the outside air which is blown into the room to be ventilated. Thus, an energy cost-saving results by recovering heat from the exhaust air.

The capillary impeller in a known heat-recovering fan is effective as a heat exchanger and as an air conveyer. This double operation of the capillary impeller does not utilize the maximum heat storage capacity of the material. That is, a compromise must be made between the heat storage capacity, on the one hand, and the air conveying capacity, on the other hand. Such a compromise always calls for certain concessions concerning one factor or the other, and an optimum of heat storage capacity is at the charge of the conveying capacity and vice versa.

Moreover, limits are set to the demand after a compact construction of the blower and undesirably restrict the practical use of the prior art heat-recovering fan. Furthermore, noise problems arise with respect to the air-conveying capillary impeller due to its construction which may also cause further restrictions either in the degree of heat recovery or in its air conveying capacity.

SUMMARY OF THE INVENTION

The invention provides a heat recovering fan having a capillary impeller. The optimum heat storage capacity of the capillary impeller is used for effecting a very high degree of heat recovery.

The heat recovering fan of this invention has at least one vane wheel used as an air conveyer in combination with the capillary impeller. Consequently, there is a separation between heat exchanger, on the one hand, and air conveyor, on the other hand. The capillary impeller may be designed exclusively on the basis of good heat exchanging properties such as type material and dimensions because the air conveyance is effected by at least one vane wheel. The air conveyance is performed by the vane wheel or vane wheels which, on their part, are designed in accordance with their sole purpose.

In an advantageous configuration of the invention, each fan may operate radially or axially. That is, each vane wheel may be designed as a radial vane wheel or also as an axial vane wheel. The capillary impeller may be a ring or disk. The separating plate may be arranged to be stationary or movable with respect to the capillary impeller. The selection is dictated by the requirements of application of the heat recovering fan.

The vane wheel may be arranged coaxially relative to the capillary impeller. A radial vane wheel may be provided concentrically inside or outside an annular capillary impeller. A very compact construction of the total fan results by the separation between the heat-storing capillary impeller and the air-conveying vane wheel.

The axial vane wheel may be coaxially disposed outside and ahead of the axial suction chamber of the capillary impeller. Thus, spent air and outside air currents are introduced axially into the capillary impeller and discharged separately through the walls of the impeller to supply air and exhaust air outlets.

The axis of rotation of an axial suction chamber of the capillary impeller may be arranged in and to extend transversely with respect to the exhaust air and supply air currents. If so, the capillary impeller causes a reversal of the outside air and spent air currents. To reduce the pressure loss in such a system, the reversal of air currents is avoided. The capillary impeller is disposed with transversely directed axis of rotation in the spent air and exhaust air currents as well as outside and supply air currents conducted in parallel relative to each other. The air currents do not enter the axial absorption or suction chamber of the capillary impeller but tangentially impinge on it to straightly flow through it at both sides of the separating plate inside the ring.

In another embodiment, a plate-shaped capillary impeller has at least one separating plate fixedly connected therewith. The capillary impeller is driven advantageously well-timed, namely in angular stepsof 90° or 180°. The fan may operate radially or axially as a countercurrent device. In all cases, the efficiency is excellent.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

FIG. 1 is a schematic sectional view along line I—I of FIG. 2 of the inside of a fan with spiral housing.

FIG. 2 is a schematic top plan view of the arrangement according to FIG. 1.

DETAILED DESCRIPTION

In a housing 1 of sheet plate or plastic, a capillary impeller 2 is supported rotatably. The capillary impeller 2 is designed as a ring having an air permeable wall due to a suitable inner structure. The wall is capable of serving as a storage mass for the exchange of heat between two air currents of different termperature. The capillary impeller 2 may be e.g. a fiber crown rotor or made of large-pore foam or the like.

Figure 1A:
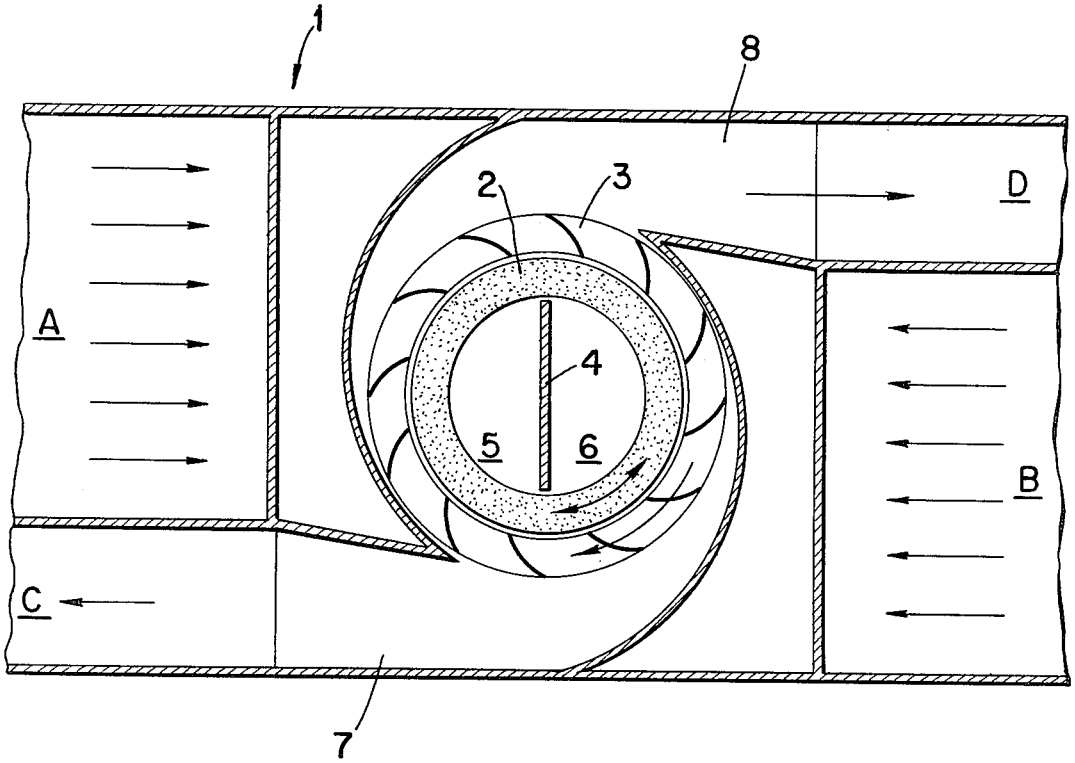
FIG. 1*a* is a schematic sectional view of another embodiment of the type fan shown in FIG. 1.

FIGS. 1 and 2 show a radial vane wheel 3 concentrically and rotatably mounted inside capillary impeller 2. FIG. 1*a* shows the radial vane sheel 3 concentrically and rotatably mounted outside the capillary impeller 2. A separating plate 4 of suitable material is inserted into the free inner chamber within annular wheel 3. Separating plate 4 is substantially immovable and divides the capillary impeller inner space into two chambers 5 and 6. Thus, plate 4 separates the axially absorbed spent air current and the outside air current and forms a bipartite axial suction hole. The spent air current enters into chamber 5, while the outside air current gets into chamber 6. Additionally, housing 1 has two outlet openings on apertures 7 and 8 which are radially opposite with respect to each other. Supply air is discharged from outlet opening 7 and exhaust air is discharged from outlet opening 8. This configuration is particularly suitable for large rooms because high pressures are building up in spiral housing.

Figure 4:
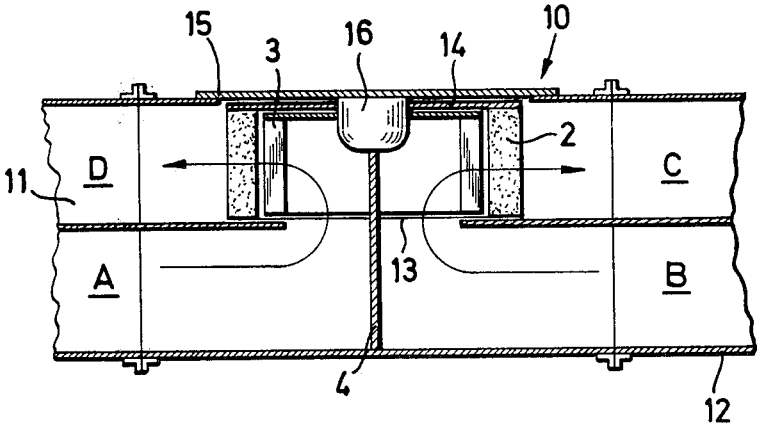
FIG. 4 is a schematic sectional view of the arrangement according to FIG. 3.

Capillary impeller 2 and radial vane wheel 3 may have a common drive from motor 16 as shown in FIG. 4. In such a case, radial vane wheel 3 may be driven directly while capillary impeller 2 is supported to be freely rotatable on balls. Thus, air current generated by radial vane wheel 3 rotates impeller 2. If necessary, the speed of the impeller 2 may be slowed down conveniently to ensure a better heat exchange. Subject to the selected type of drive, the impeller 2 and wheel 3 may rotate in either the same or opposite direction. Their speed of rotation may be equal or different. It has been determined that the heat exchange is greater when capillary impeller 2 rotates more slowly than vane wheel 3. Known high-output vane wheel blowers which operate extremely silently may be used. Furthermore, the speed of the capillary impeller may be selected to substantially eliminate any audible disturbing noise of operation for the fan of this invention. In any event, as is evident in the drawings and as described herein, capillary impeller 2 rotates separately from the independently rotatable radial vane wheel 3.

A hotter spent air current A and a colder outside air current B are absorbed or pulled by radial vane wheel 3 into the axial suction chambers 5 and 6 and blown radially outwardly to the outside against the wall of capillary impeller 2. The inner structure of capillary impeller 2 causes the capillary race to become effective as a heat exchange. When the spent air current and outside air current each pass through the capillary race, the higher temperature of the spent air current A is transferred to the outside current B thereby heating the supply air C admitted through the outlet opening 7 into the room to be air-conditioned. The exhaust air D is cooled and passes outside from the outlet aperture B. The degree of heat recovery of the supply air C is above 50% and, moreover, at least 40% of air humidity is recycled into the room.

Figure 3:
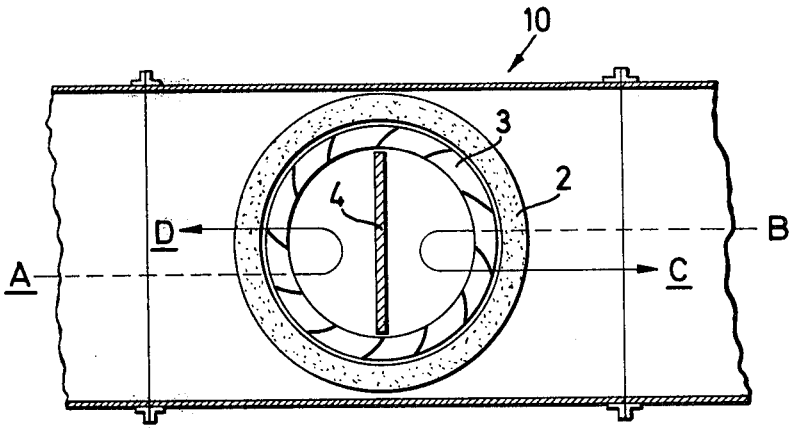
FIG. 3 is a schematic sectional view of the inside of another embodiment of a fan.

The working example of FIGS. 3 and 4 is similar to the example of FIGS. 1 and 2. However, instead of a housing having spiral outlets, housing 10 is box-shaped and includes two parallel tubes 11 and 12 placed side-by-side and having a rectangular cross-section. Tubes 11 and 12 are disposed side-by-side and have a common wall with a circular hole 13 serving as a suction hole. The opposite wall of tube 11 has another circular hole 14 having a diameter that corresponds substantially to the outer diameter of capillary impeller 2. Cover plate 15 closes circular hole 14 upon assembly of capillary impeller 2 and of radial vane wheel 3.

Separating plate 4 is centrally mounted in the axial suction chamber of capillary impeller 2 and of the radial vane wheel 3 and extends between drive motor 16 and the outer wall of tube 12. The spent air A and the outside air B are absorbed or pulled through the lateral openings formed on each side of plate 4 in opening 13 into tube 12. Air currents A and B separately enter into the axial suction chamber of capillary impeller 2 and of vane wheel 3. Upon termination of heat exchange, currents A and B leave tube 11 as supply air current C and exhaust air current D. The supply air C flowing into the room to be ventilated has been heated in the same manner as explained with respect to Example of FIGS. 1 and 2.

Instead of radial vane wheel 3 being placed concentrically in capillary impeller 2, an axial vane wheel may be placed coaxially before capillary impeller 2. This alternative may be chosen subject to the requirements of mounting or to the air conveyor capacity and the like.

Figure 5:
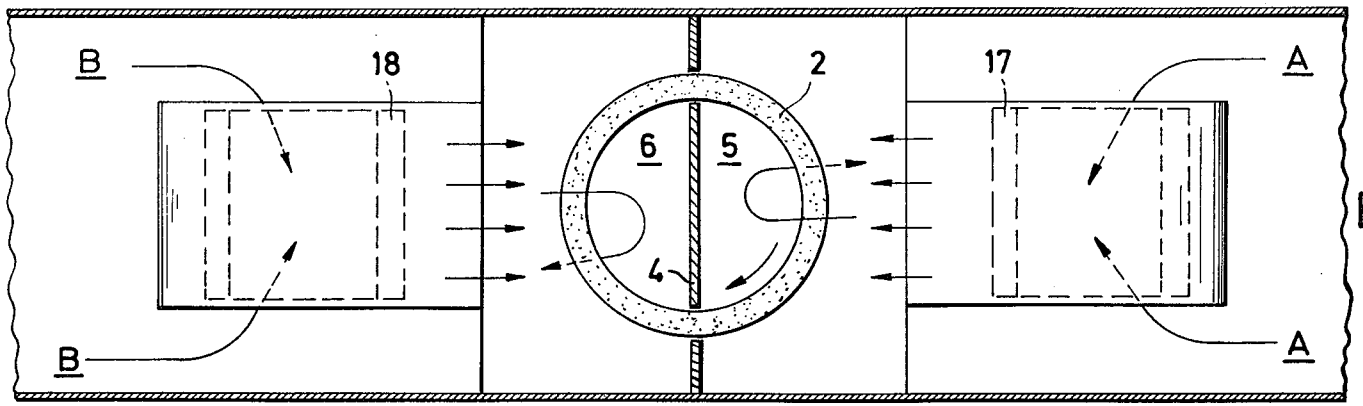
FIG. 5 is a schematic sectional view of the inside of another embodiment of a fan having two vane wheels.
Figure 6:
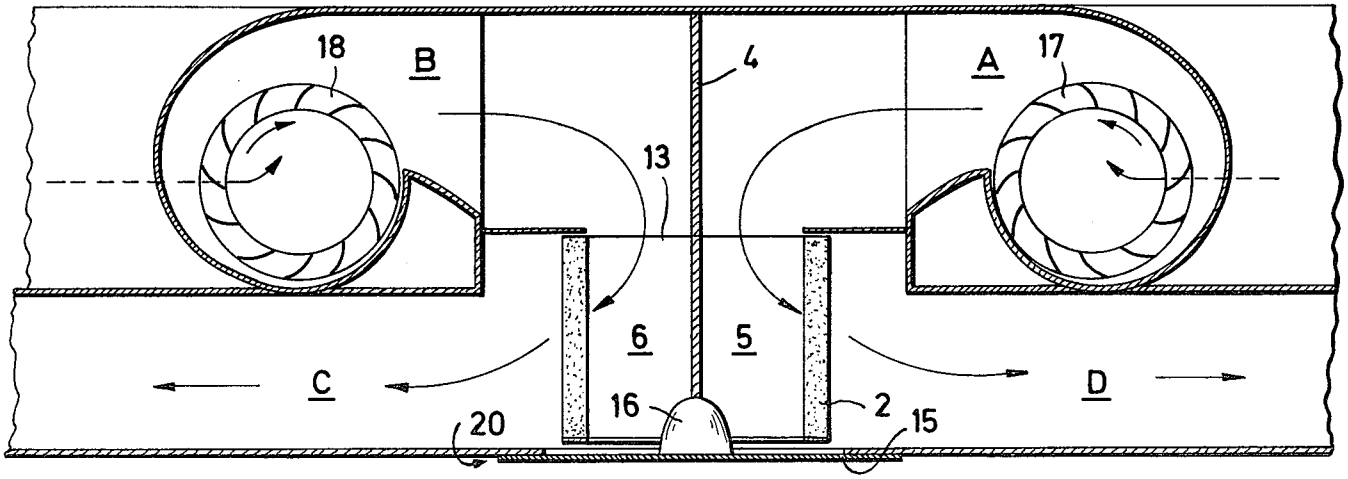
FIG. 6 shows a schematic sectional view of the arrangement according to FIG. 5.

One sole vane wheel is assigned to the capillary impeller in the examples of FIGS. 1 to 4. However, two vane wheels are used in each of the two examples of FIGS. 5 to 7.

A capillary impeller 2 is mounted in housing 20 and caused to rotate by a motor 16. The axial suction chamber is divided into two halves by separating plate 4. Plate 4 extends into the spent air and fresh air channels so that two air currents A and B separately enter into the axial suction chamber of capillary impeller 2. A radial blower 17 is mounted in the spent air channel and conveys spent air A from one room. A secoond radial blower 18 conveys outside air B and is located in the outside air channel. After spent air current A and outside air current B have passed along capillary race 2 with the attendant heat exchange, the heated supply air C enters into the room to be air-conditioned and the cooled exhaust air D is discharged to the outside.

The speed of rotation of capillary impeller 2 may be different from that of the two radial blowers 17 and 18. If necessary, all three elements 2, 17 and 18 may have the same speed. The capillary impeller 2 is well accessible by removing the housing cover 15 to quickly and simply assemble and disassemble for maintenance and cleaning. By fitting radial blowers 17 and 18 outside capillary impeller 2, the bearing problems are simpler than with the two preceding working examples in which the radial vane wheel is arranged concentrically. The two vane wheels 17 and 18 either act as a pressure or as a suction conveyer.

Figure 7:
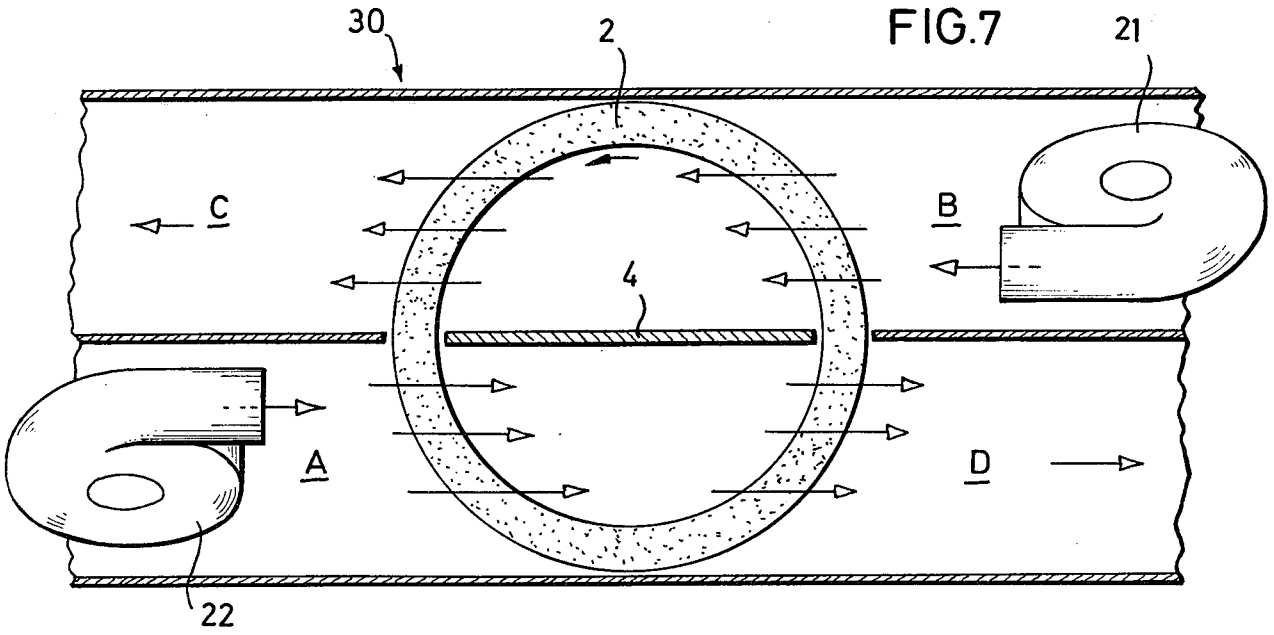
FIG. 7 is a schematic sectional view of the inside of another embodiment of a fan having two vane wheels.

The embodiment of FIG. 7 avoids reversal of spent air and outside air currents A and B with the passage through capillary impeller 2 and reduces pressure loss. The capillary impeller 2 is mounted with transversely directed axis of rotation in substantially straight channels for supply air C, outside air B, spent air A, and exhaust air D. A vane wheel blower 21 is placed into the outside air channel and a vane wheel blower 22 is mounted in the spent air channel. As shown, blowers 21 and 22 may be either a radial or an axial blower. The air currents generated by the two vane wheel blowers 21 and 22 flow in the direction of the arrows at both sides of the separating plate 4. Thus, the air currents A and B blow straight inside capillary impeller 2 through its wall and out of housing 30 as supply air current C and exhaust air current D.

Unlike the preceding working examples, an axial absorption or suction chamber does not exist in impeller 2 of this embodiment of the heat-recovering fan, but the air currents pass through capillary impeller 2 free of reversal. To obtain the correct separation of the parallel air current, separating plate 4 is in the same place of separating wall 4 between the two tubes of housing 30.

Figure 8:
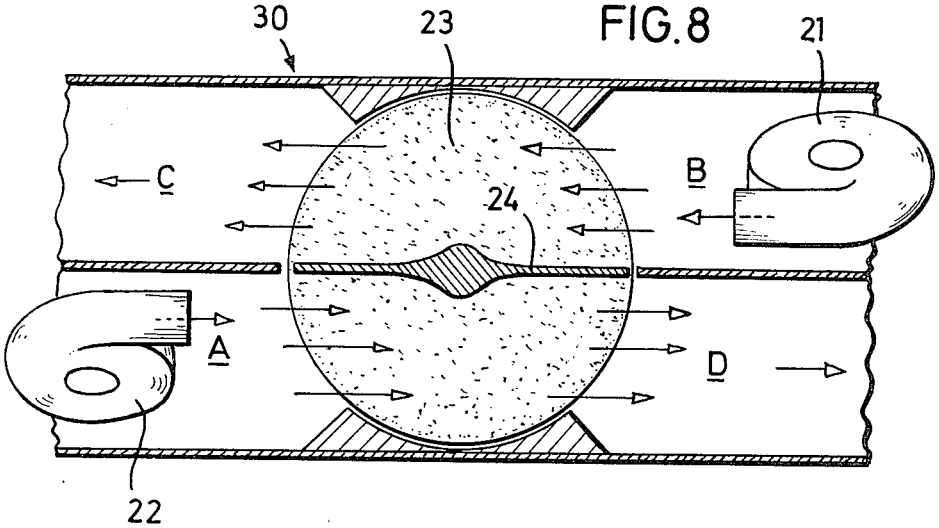
FIG. 8 is a schematic sectional view of an embodiment of a fan having a plate shaped capillary impeller.

In the embodiment of FIG. 8, capillary impeller 23 is a plate body into which a separating plate 24 is mounted to be stationary and movable therewith. The length of the separating plate 24 corresponds substantially to the diameter of capillary impeller 24 to form a complete separation of the air currents. Capillary impeller 23 with separating plate 24 is driven well-timed, namely, always by 180°. The amount of heat stored with each half rotation of capillary impeller 23 is transferred into the room with the supply air current C. The degree of heat recovery is extremely high due to the complete separation of the air currents in capillary impeller 23 and its enlarged storage capacity.

Figure 9:
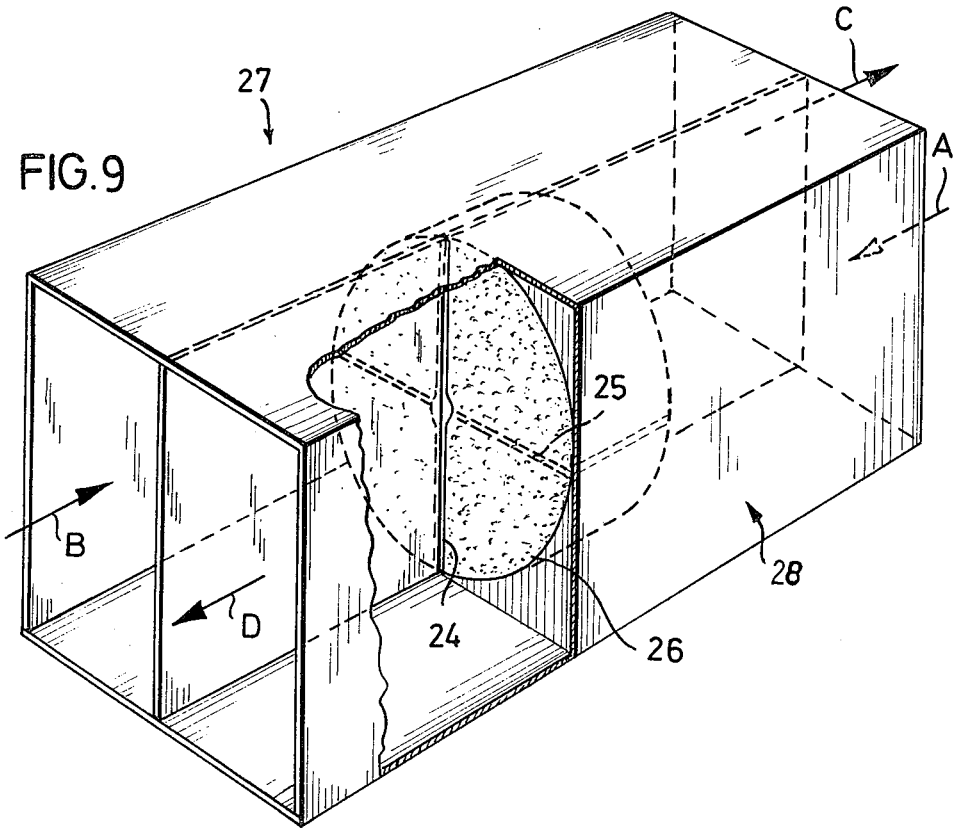
FIG. 9 is a perspective view partially in section of another embodiment of a fan with a plate-shaped capillary impeller.

The embodiment of FIG. 9 includes a plate-shaped capillary impeller 26 subdivided into two halves or four quarter sectors by two mounted separating plates 24 and 25. Capillary impeller 26 is housed in a casing composed of two tubes 27 and 28. Thus, air currents flow axially therethrough; namely, outside and supply air currents B and C flow in one direction and the spent air and exhaust air currents A and D fow in the opposite direction. The capillary impeller 26 is driven well-timed optional step sequence, e.g. by 90° or by 180°.

Subject to the many possible variations concerning the configuration of the capillary impeller and its combination with the vane wheel air conveyors, it is possible to construct the heat-recovering fan for practically all applications imaginable. Both large and small rooms may be ventilated and air-conditioned with a heat-recovering fan adapted to them. The costs are low for power consumption of the independently driven vane wheel or vane wheels compared to the high degree of heat recovery from the exhaust air which includes the heat yielded in rooms from illumination, machines, persons, etc.

What is claimed is:

1. A heat-recovering device for simultaneously aerating and deaerating rooms comprising:

(a) separate spent air and outside air inlets and separate supply air and exhaust air outlets, (b) a rotatable capillary impeller located in exchanger, (c) a separating plate means to separate air currents, (d) at least one vane wheel being separately rotatable from said capillary impeller and effective to convey air directly against parts of the capillary impeller, (e) said parts facing the outside air inlet and spent air inlet, and (f) means to independently rotate said vane wheel coaxially with respect to said capillary impeller.

2. A device as defined in claim 1, wherein each vane wheel comprises a radial vane wheel.

3. A device as defined in claim 1, wherein drive means are effective to rotate the vane wheel and the capillary impeller in the same direction.

4. A device as defined in claim 1, wherein drive means are effective to rotate the vane wheel and the capillary impeller in opposite directions.

5. A device as defined in either claim 3 or 4 wherein drive means are effective to rotate the vane wheel and the capillary impeller at the same speed.

6. A device as defined in either claim 3 or 4 wherein drive means are effective to rotate the vane wheel and the capillary impeller each at different speeds.

7. A device as defined in claim 1 wherein common drive means are effective to rotate the capillary impeller and the vane wheel.

8. A device as defined in claim 1 wherein the impeller and vane wheel are interfitted with respect to each other, the outer wheel is supported freely rotatable on balls and drive means drive the inner wheel.

9. A device as defined in claim 1 wherein the vane wheel is effective as pressure conveyor.

10. A device as defined in claim 1 wherein the capillary impeller is annular, and the capillary impeller and a radial vane wheel are disposed concentrically with respect to each other, a housing includes an axially directed suction hole, radially opposite outlet holes, and contains the impeller and radial vane wheel, said suction hole is for spent air and outside air currents and said radially opposite outlet holes are for exhaust air and supply air currents.

11. A device as defined in claim 1 wherein the capillary impeller is annular, a housing includes an axially directed suction hole and outlet holes, said suction hole being for spent air and outside air and said outlet holes being for exhaust air and supply air currents, the capillary impeller and the coaxially fitted vane wheel being disposed in the housing, the axes of rotation for the impeller and vane wheel being located in the exhaust air and supply air currents and extending transversely relative thereto.

12. A device as defined in claim 1 wherein the vane wheel is effective as a suction conveyor.

13. A device as defined in claim 1 wherein said vane wheel produces a volume flow directed immediately against the portion of the capillary impeller facing the outside air inlet (B) and the spent air inlet (A).

14. A heat-recovering device for simultaneously aerating and deaerating rooms comprising:

(a) separate spent air and outside air inlets and separate supply air and exhaust air outlets, (b) a rotatable annular capillary impeller located in communication with said air outlets and constituting a heat exchanger, (c) a separating plate means to separate air currents, and (d) at least one radial vane wheel is disposed concentrically within the capillary impeller and is effective to convey air directly against parts of the capillary impeller, (e) said parts facing the outside air inlet and spent air inlet.

15. A heat-recovering device for simultaneously aerating and deaerating rooms comprising:

(a) separate spent air and outside air inlets and separate supply air and exhaust air outlets, (b) a rotatable capillary impeller located in communication with said air outlets and constituting a heat exchanger, (c) a separating plate means to separate air currents, (d) at least one vane wheel being effective to convey air directly against parts of the capillary impeller, (e) said parts facing the outside air inlet and spent air inlet, and (f) the vane wheel is fitted coaxially with respect to the capillary impeller.

16. A heat-recovering device for simultaneously aerating and deaerating rooms comprising:

(a) separate spent air and outside air inlets and separate supply air and exhaust air outlets, (b) a rotatable, annular capillary impeller located in communication with said air outlets and constituting a heat exchanger, (c) a separating plate means to separate air currents, and (d) at least one radial vane wheel is disposed concentrically outside the capillary impeller and is effective to convey air directly against parts of the capillary impeller, (e) said parts facing the outside air inlet and spent air inlet.

* * * * *